US008282439B2

(12) United States Patent
Han

(10) Patent No.: US 8,282,439 B2
(45) Date of Patent: Oct. 9, 2012

(54) DOLL WITH FLEXIBLE ARMS AND LEGS

(76) Inventor: Cheng-Hua Han, Taichung (TW)

( * ) Notice: Subject to any disclaimer, the term of this patent is extended or adjusted under 35 U.S.C. 154(b) by 368 days.

(21) Appl. No.: 12/654,723

(22) Filed: Dec. 30, 2009

(65) Prior Publication Data

US 2011/0159777 A1 Jun. 30, 2011

(51) Int. Cl.
*A63H 3/46* (2006.01)

(52) U.S. Cl. ..... 446/382; 446/374; 446/383; 446/390

(58) Field of Classification Search ..... 446/373–375, 446/382, 376, 320, 177, 335, 390; 114/218; *A63H 3/04, 3/36, 3/66*
See application file for complete search history.

(56) References Cited

U.S. PATENT DOCUMENTS 1,364,881 A * 1/1921 Koch ..... 446/374
1,591,661 A * 7/1926 Dinsdale ..... 446/374
2,020,079 A * 11/1935 Rabel ..... 446/297
2,219,130 A * 10/1940 Herrmann ..... 446/177
3,574,968 A * 4/1971 Schlau et al. ..... 446/97
4,361,938 A * 12/1982 Emery ..... 24/130
5,931,560 A * 8/1999 Hoffman ..... 362/124

FOREIGN PATENT DOCUMENTS

EP 566799 A1 * 10/1993
GB 2153904 A * 8/1985
WO WO 2007/028370 A1 * 9/2006

* cited by examiner

*Primary Examiner* — Gene Kim
*Assistant Examiner* — Matthew B Stanczak

(57) ABSTRACT

A doll includes a body which is formed by two body cases and two flexible members are clamped by the two body cases. A flexible neck is connected to the top of the body and a head is connected to the flexible neck. Two arms are respectively connected to two arm ends of the two flexible members and each arm is composed of two arm cases. Two hands are pivotably connected to the two arms. The doll can be assembled quickly and firmly without using any nail. The arms, legs and head can be moved naturally to increase the value of the doll.

3 Claims, 7 Drawing Sheets

DOLL WITH FLEXIBLE ARMS AND LEGS

BACKGROUND OF THE INVENTION (1) Field of the Invention

The present invention relates to a doll, and more particularly, to a doll having flexible arms and legs, and the doll can be assembled quickly.

(2) Description of the Prior Art

A conventional doll generally includes four limbs and a head and some of the dolls are designed to have movable limbs and head and some have fixed limbs and head. FIGS. 1 to 3 show a conventional doll having movable limbs and head, and the conventional doll generally includes a wood body 10 with two grooves 11 defined in two sides thereof. A head is connected to the top of the body 10 and two flexible members 20 are fixedly engaged with the grooves 11 by nails 25. The flexible members 20 each have a hand end 21 and a leg end 22, and the head end 21 is inserted into the first hole 31 in the hand 30 and the leg end 22 is inserted into the second hole 36 in the leg 35. The hand 30 and the leg 35 are then respectively glued to the flexible members 20.

In order to make sure that the nails 25 are properly fix the flexible members 20 to the body 10, the assemblers have to carefully keep the nails 25 to be nailed into the body 50 and perpendicular to the axis of the body 50. Furthermore, the nails 25 cannot be too long to protrude from the body 50. Because the flexible members 20 are nailed to the body 50 so that the hands 30 and the legs 35 at the distal ends of the flexible members 20 are restricted when moving. The restriction can reduce the attraction of the users and the nails 25 are not able to provide firm connection between the flexible members 20 and the body 50.

The present invention intends to provide a doll with movable limbs wherein the flexible members are not nailed to the body and clamped by clamping plates which provide the flexible members more freedom degree so that the limbs can be posed as desired.

SUMMARY OF THE INVENTION

The present invention relates to a doll comprising a body composed of two body cases and the body has a neck hole in a top thereof, two arm holes in two sides thereof and two leg holes in an underside thereof. A flexible neck is inserted in the neck hole and a head is connected to a top of the neck. Two flexible members respectively extend through the two leg holes and the two arm holes. Each flexible member has an arm end and a leg end on two ends thereof. An arm is connected to the arm end of each of the two flexible members and a leg is connected to the leg end of each of the two flexible members.

The primary object of the present invention is to provide a doll which is easily assembled so as to increase the production speed.

Another object of the present invention is to provide a doll wherein the arms, the legs and the head can be moved naturally.

The present invention will become more obvious from the following description when taken in connection with the accompanying drawings which show, for purposes of illustration only, a preferred embodiment in accordance with the present invention.

DETAILED DESCRIPTION OF THE PREFERRED EMBODIMENT

Figure 1:
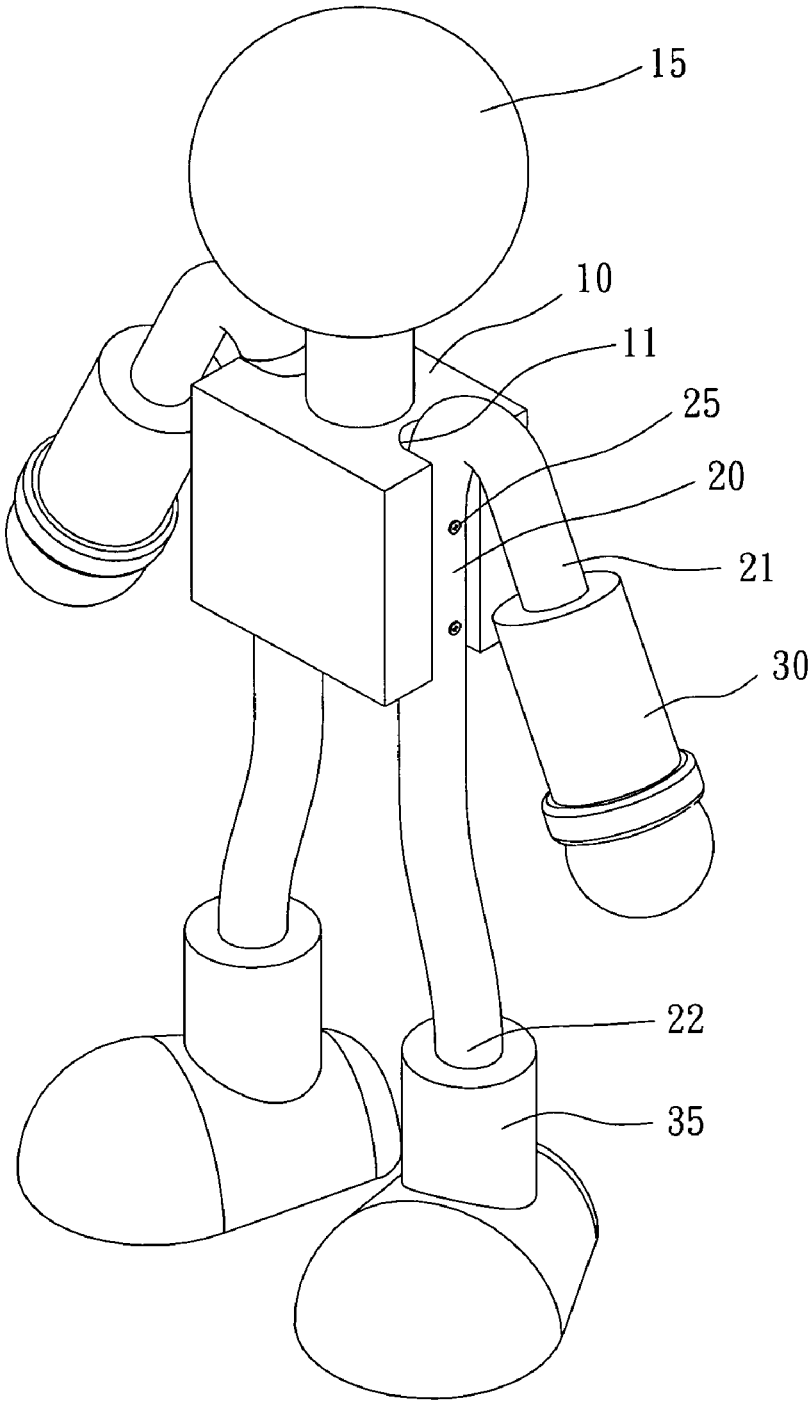
FIG.1 Prior Art
FIG. 1 is a perspective view to show the conventional doll.
Figure 2:
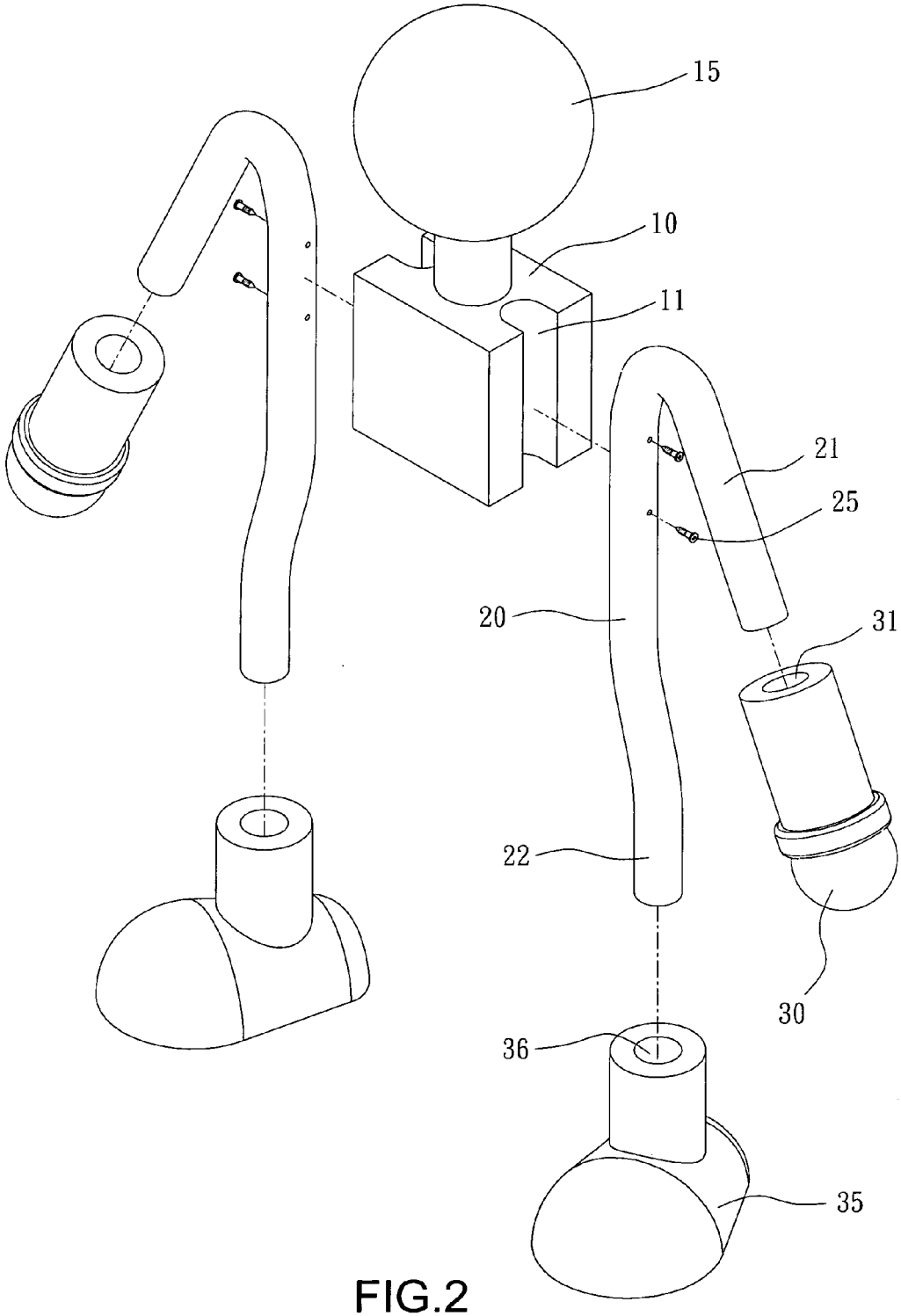
FIG.2 Prior Art
FIG. 2 is an exploded view to show the conventional doll.
Figure 3:
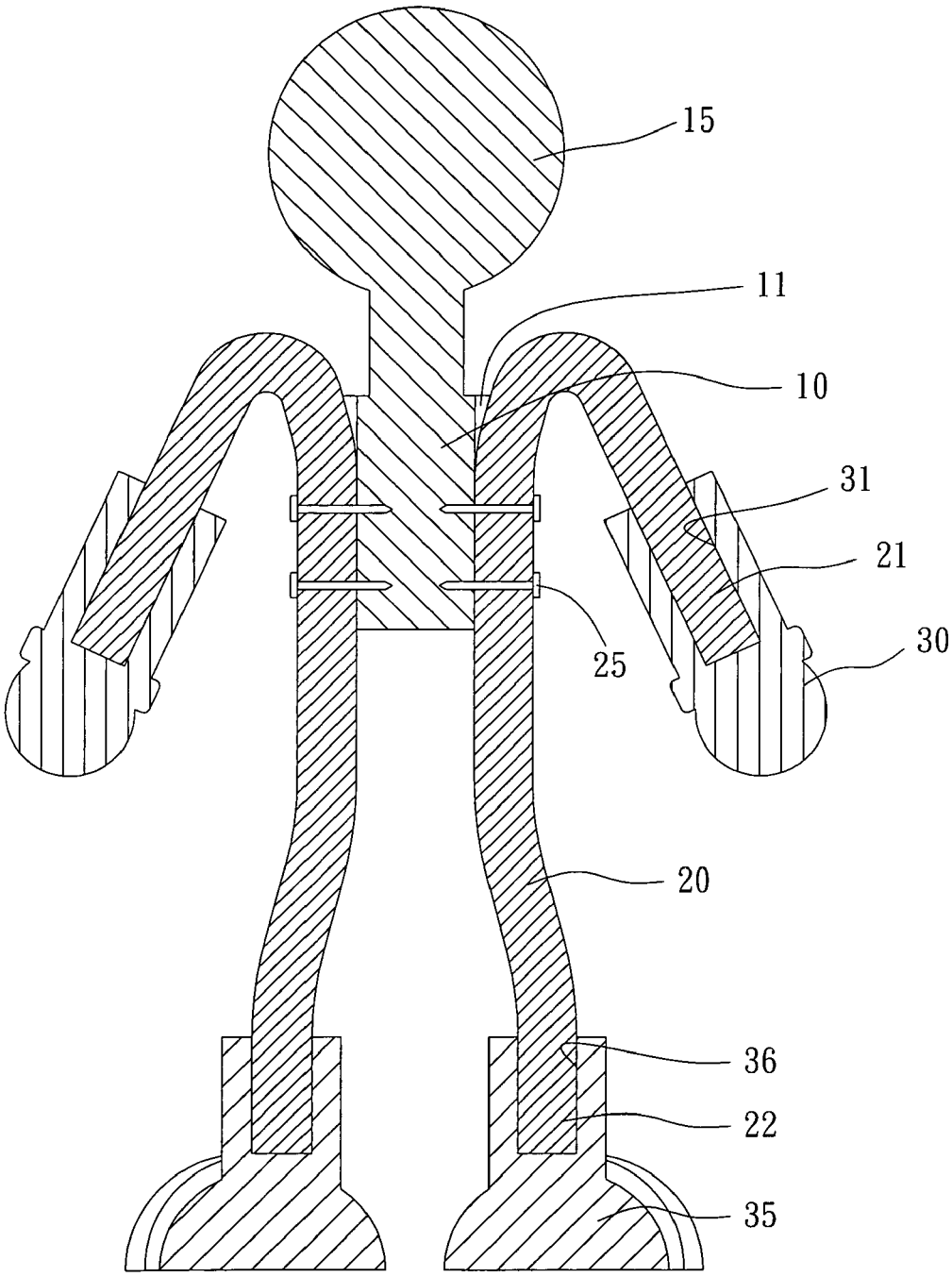
FIG.3 Prior Art
FIG. 3 is a cross sectional view of the conventional doll.
Figure 4:
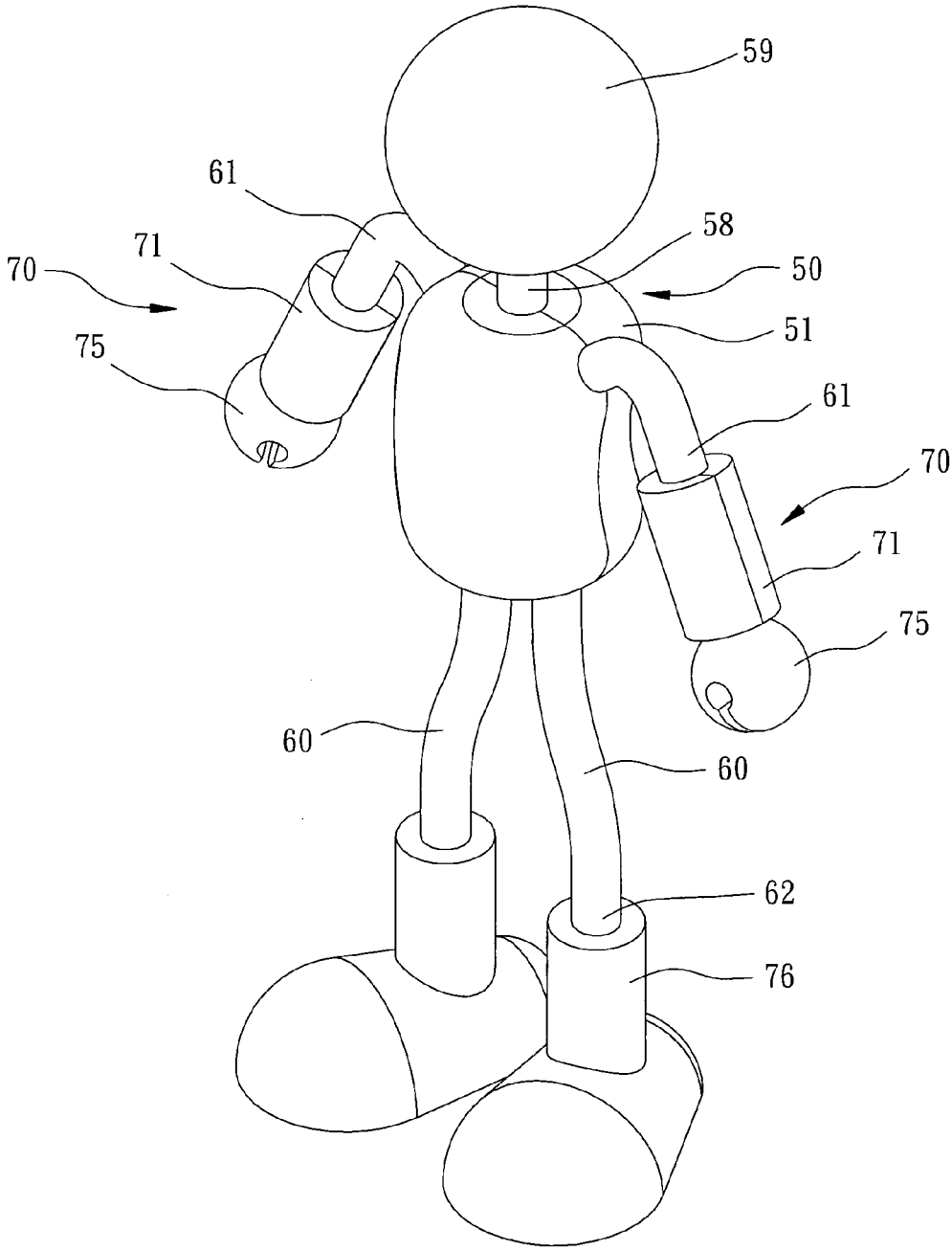
FIG. 4 is a perspective view to show the doll of the present invention.
Figure 5:
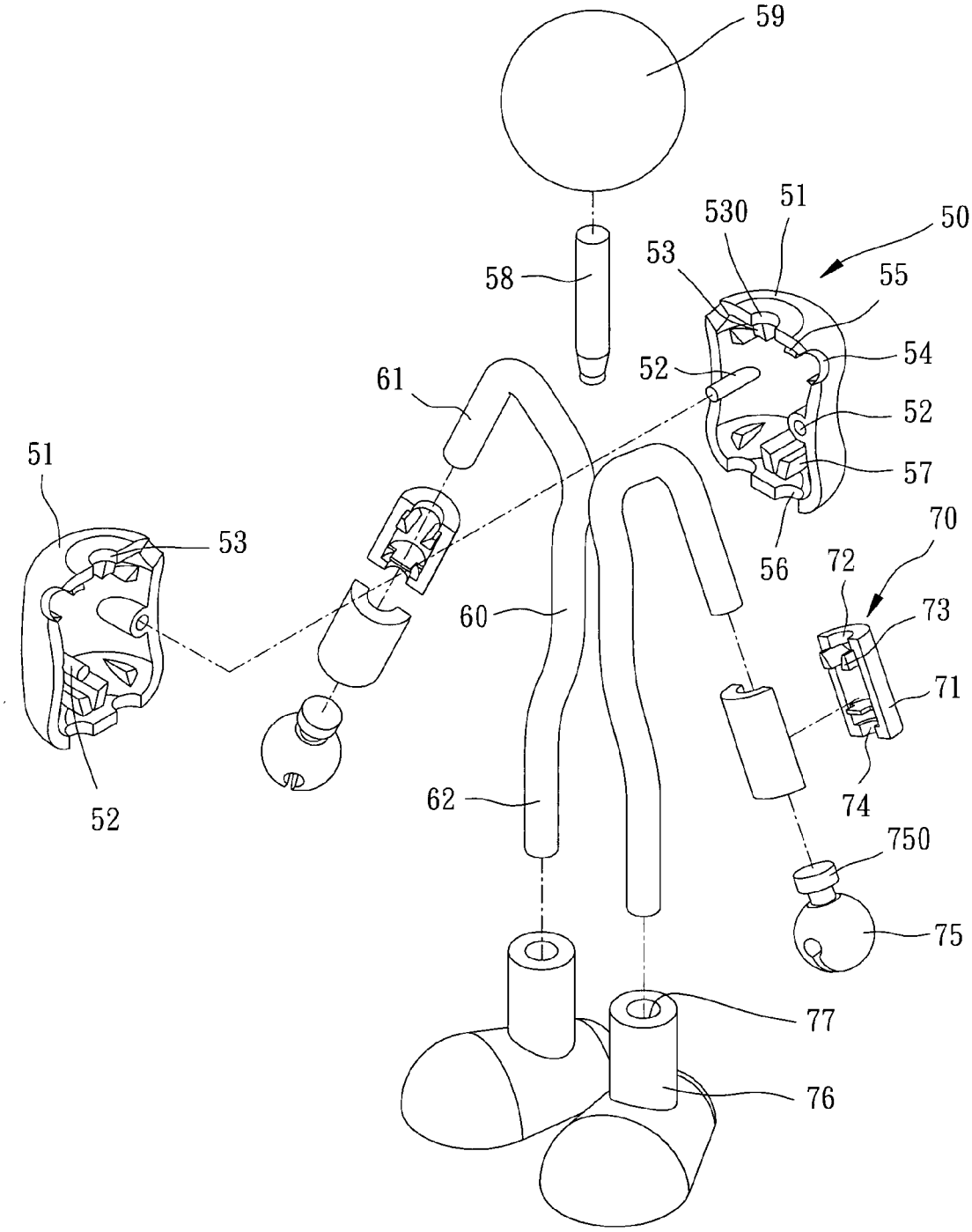
FIG. 5 is an exploded view to show the doll of the present invention.
Figure 6:
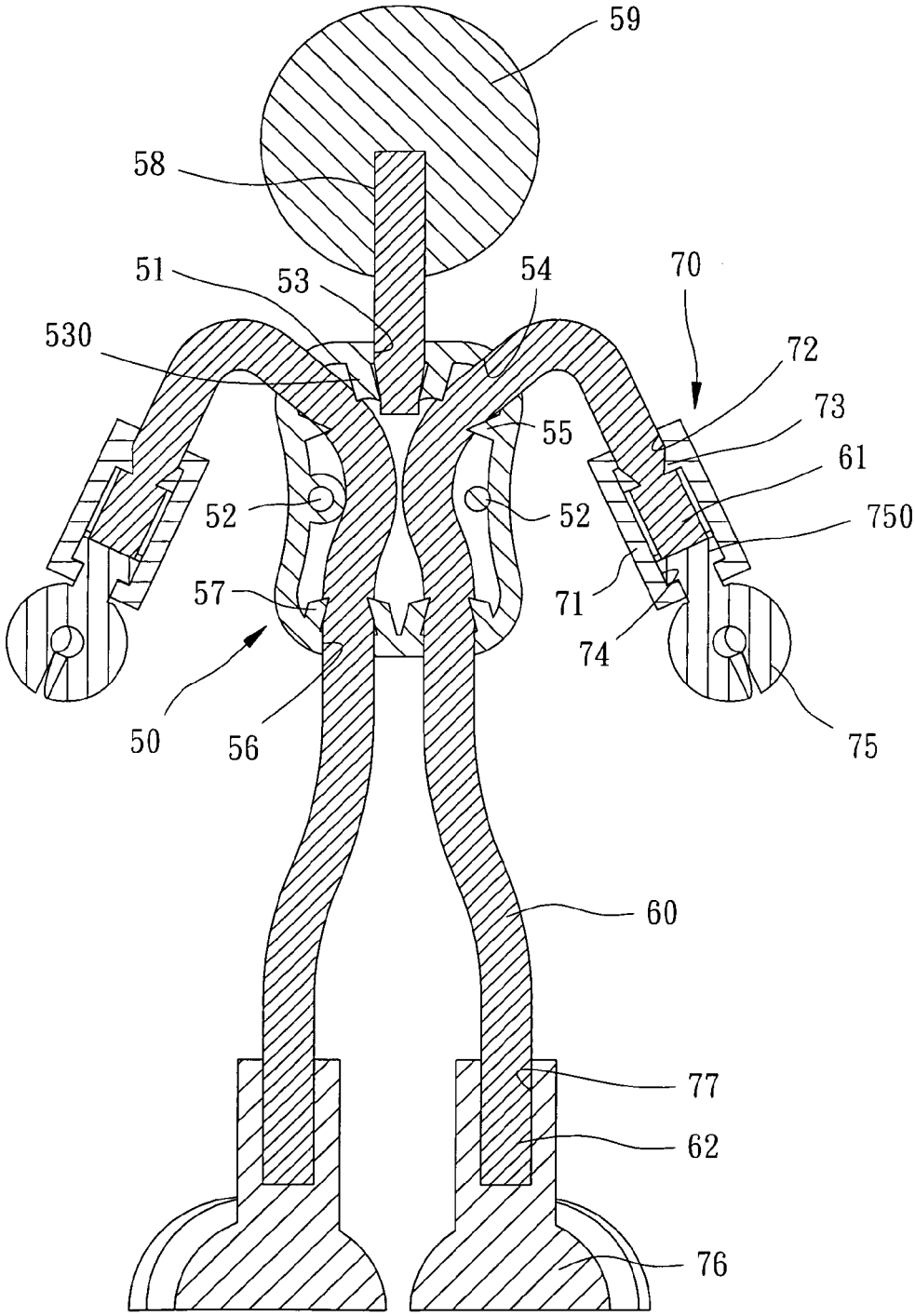
FIG. 6 is a cross sectional view of the doll of the present invention.

Referring to FIGS. 4 to 6, the doll of the present invention comprises a plastic body 50 and two flexible members 60. The body 50 comprises two body cases 51 and each of the body cases 51 includes multiple connection portions 52 located at an inside thereof and the connection portions 52 of the two body cases 51 are connected to each other to form the body 50. The connection portions 52 can be rods and tubes as shown in FIG. 5. The body 50 has a neck hole 53 in a top thereof, two arm holes 54 in two sides thereof and two leg holes 56 in an underside thereof. A flexible neck 58 inserted in the neck hole 53 and a head 59 connected to a top of the neck 58. Two first clamping plates 530 are located at the inside of each of the body cases 51 and the neck hole 53 is located between the first clamping plates 530. A gap between the first clamping plates 530 is smaller than a diameter of the neck 58 so that the neck can be clamped by the first clamping plates 530.

Two flexible members 60 respectively extend through the two leg holes 56 and the two arm holes 54. Two second clamping plates 55 are located at the inside of each of the body cases 51 and the arm hole 54 is located between the second clamping plates 55. A gap between the second clamping plates 55 is smaller than a diameter of the flexible members 60 so that the flexible members 60 can be clamped by the second clamping plates 55. Two third clamping plates 57 are located at the inside of each of the body cases 51 and the leg hole 54 is located between the third clamping plates 57. A gap between the third clamping plates 57 is smaller than a diameter of the flexible members 60 so that the flexible members 60 can be clamped by the third clamping plates 57.

Each flexible member 60 has an arm end 61 and a leg end 62 on two ends thereof. An arm 70 is connected to the arm end 61 of each of the two flexible members 60 and a leg 76 is connected to the leg end 62 of each of the two flexible members 60.

Each arm 70 is composed of two arm cases 71 and includes a connection hole 72 in a first end thereof, and a reception hole 74 is defined in a second end of the arm 70. A hand 75 is connected to the second end of the arm 70 and includes an enlarged portion 750 which is pivotably engaged with the reception hole 74. Two fourth clamping plates 73 extend from an inside of each of the arm cases 71 and the connection hole 72 is located between the fourth clamping plates 73. A gap between the fourth clamping plates 73 is smaller than a diameter of each of the flexible members 60 which are clamped by the fourth clamping plates 73. Each legs 76 has an insertion hole 77 in which the leg end 62 is inserted and glued.

Figure 7:
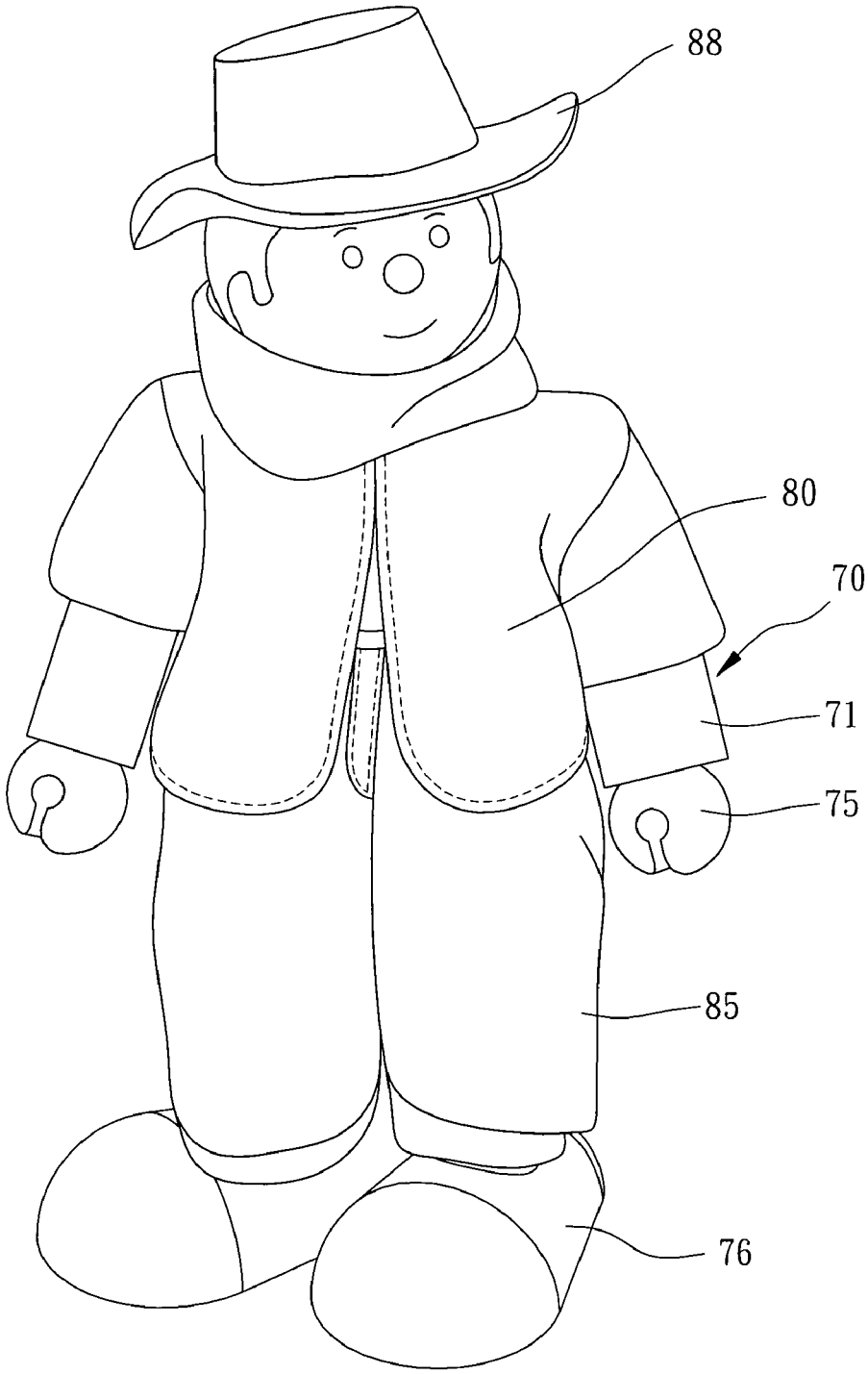
FIG. 7 shows the dressed doll of the present invention.

When assembling, the two respective middle sections of the two flexible members 60 are engaged with the arm holes 54 and the leg holes 56 of one of the two body cases 51, and are clamped by the second and third clamping plates 55, 57. The neck 58 is engaged with the neck hole 53 and positioned by the first clamping plates 530. The other body case 51 is then connected to the previous body case 51. The head 59 is then connected to the neck 58. The legs 76 are glued to the leg ends 62 of the flexible members 60 and two arms 70 are connected to the hand ends 61. The two hands 75 are then pivotably connected to the arms 70 by engaging the enlarged portions 750 with the reception holes 74 in the arms 70. The doll can be dressed by a cloth 80, pants and a cap 88 as shown in FIG. 7.

The flexible members 60 can be bent as desired to move the hands 75, the legs 76 and the head 59 naturally. The doll does not need any nail so that the assembling can be quick and efficient. The shortcomings of the conventional dolls can be improved.

While we have shown and described the embodiment in accordance with the present invention, it should be clear to those skilled in the art that further embodiments may be made without departing from the scope of the present invention.

What is claimed is:

1. A doll comprising:

a body comprising two body cases which are connected to each other to form the body, the body having a neck hole in a top thereof, two arm holes in two sides thereof and two leg holes in an underside thereof, a flexible neck inserted in the neck hole and a head connected to a top of the neck, and two flexible members respectively extending through the two leg holes and the two arm holes, each flexible member having an arm end and a leg end on two ends thereof, an arm connected to the arm end of each of the two flexible members and a leg connected to the leg end of each of the two flexible members, each arm being composed of two arm cases and including a connection hole in a first end thereof and a reception hole in a second end thereof, a hand connected to the second end of the arm and including an enlarged portion which is pivotably engaged with the reception hole, two first clamping plates located at an inside of each of the body cases and the neck hole located between the first clamping plates, a gap between the first clamping plates being smaller than a diameter of the neck which is clamped by the first clamping plates, two fourth clamping plates extending from an inside of each of the arm cases and the connection hole being located between the fourth clamping plates, a gap between the fourth clamping plates being smaller than a diameter of each of the flexible members which are clamped by the fourth clamping plates.

2. The doll as claimed in claim 1, wherein each of the body cases includes multiple connection portions located at an inside thereof and the connection portions of the two body cases are connected to each other.

3. The doll as claimed in claim 1, wherein each legs has an insertion hole in which the leg end is inserted and glued.

* * * * *